United States Patent [19]

Marton

[11] 4,287,685

[45] Sep. 8, 1981

[54] PAD ASSEMBLY FOR VACUUM ROTARY SANDER

[76] Inventor: Miksa Marton, 3620 Rankin Blvd., Windsor, Ontario, Canada

[21] Appl. No.: 967,581

[22] Filed: Dec. 8, 1978

[51] Int. Cl.[3] ..... B24B 23/00; B24B 55/06

[52] U.S. Cl. ..... 51/170 T; 51/273; 41/275; 51/381; 51/382; 51/358

[58] Field of Search ..... 51/170 T, 170 MT, 273, 51/292, 325, 356, 358, 362, 395, 398, 275, 381, 382; 15/383, 385

[56] References Cited

U.S. PATENT DOCUMENTS

| | | | |
|---|---|---|---|
| 2,479,941 | 8/1949 | Kummer | 51/356 |
| 3,754,349 | 8/1973 | Scandaletos | 51/356 |
| 3,892,091 | 7/1975 | Hutchins | 51/358 |
| 3,932,966 | 1/1976 | Stern | 51/356 |
| 4,058,936 | 11/1977 | Marton | 51/170 T |
| 4,145,848 | 3/1979 | Hutchins | 51/273 |
| 4,158,935 | 6/1979 | Robert | 51/170 T |

*Primary Examiner*—Harold D. Whitehead
*Assistant Examiner*—K. Bradford Adolphson
*Attorney, Agent, or Firm*—Burns, Doane, Swecker & Mathis

[57] ABSTRACT

A pad assembly for a vacuum rotary sander has a flexible pad body secured to a rigid head that is connectable to a vacuum housing and a pad rotating means. A plurality of apertures in the head communicate with other apertures in the lower surface of the pad by internal channels which are angled toward the direction of rotation of the pad. The apertures in the lower portion of the pad coincide with apertures in an abrasive disc removably secured to the assembly and may be elongated in the direction opposite to that of rotation so as to allow some slippage of the abrasive disc relative to the pad assembly. There is also disclosed a device for quickly positioning and loading an abrasive disc onto the pad assembly.

3 Claims, 6 Drawing Figures

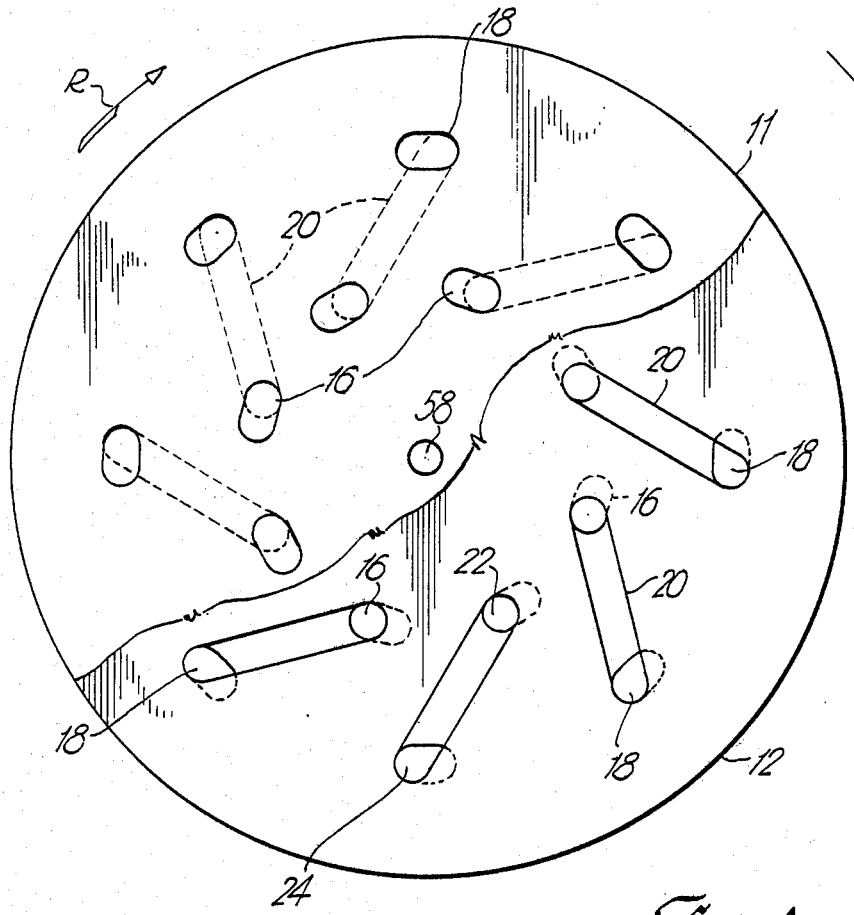
Fig-1
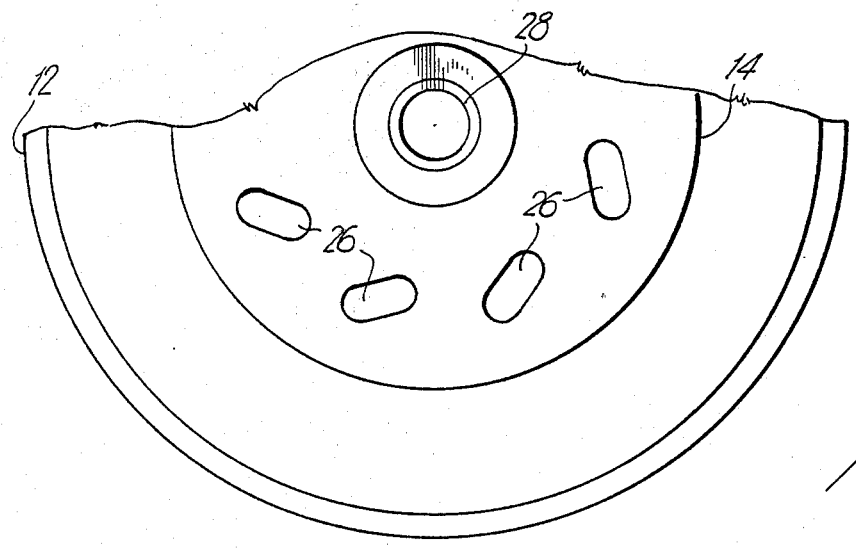

PAD ASSEMBLY FOR VACUUM ROTARY SANDER

BACKGROUND OF THE INVENTION

This invention relates to sanding devices and in particular to a pad assembly for a rotary disc sander of the vacuum type.

In my U.S. Pat. No. 4,058,936 issued Nov. 22, 1977, I have described several embodiments of a vacuum sanding device of the double-acting type. The present invention is directed specifically to a pad assembly for a rotary vacuum operated disc sander but the means for driving the disc and the vacuum creating means for the disc assembly may be the same as that in U.S. Pat. No. 4,058,936.

Rotary sanding devices revolve at fairly high speeds and are used in grinding operations and heavy duty forms of work such as automobile bodies etc. Due to the nature of the work and the varied materials to be sanded or ground, it has until this time been difficult to obtain an efficient rotary sanding assembly having an attached vacuum arrangement. This is mainly due to the fact that the ground particles clog up small passages in the disc, particularly when the pad is flexed under pressure.

The present invention overcomes the deficiencies of the prior art by providing a vacuum rotary sander with a flexible pad body that is secured to a rigid head member which in turn is connectable to a pneumatic rotating device as described in U.S. Pat. No. 4,058,936. Additionally, the rigid head may be enclosed by a vacuum housing such as that shown in U.S. Pat. No. 4,058,936 whereby the particles ground by the pad assembly are quickly and efficiently carried away from the unit. A plurality of apertures in the head communicate with other apertures in the lower surface of the pad by way of internal channels in the pad body and these channels are angled toward the direction of rotation of the pad so that there is a leading action to the vacuum function applied to the apertures when the pad is being rotated. Apertures in the lower portion of the pad coincide with apertures in an abrasive disc which is removably secured to the assembly and, in a preferable form, the apertures in the lower part of the pad are elongated in the direction opposite to that of rotation so as to allow some slippage of the abrasive disc relative to the pad assembly without losing alignment of the apertures in either member.

SUMMARY OF THE INVENTION

According to one broad aspect therefor, the present invention relates to a pad assembly for a vacuum rotary sander, said assembly comprising (a) a circular upper pad portion of firm but resilient material and having a plurality of evenly spaced apertures concentrically arranged therein and positioned approximately midway between the centre of said upper pad portion and the circumferential edge thereof, (b) and an elongated channel extending from each said aperture angularly outwardly in the direction of rotation of the assembly, each said channel being open along its bottom edge, (c) a lower pad portion of relatively soft flexible material and having an inner and outer row of evenly spaced concentrically arranged apertures therein, said lower pad portion being bonded to said upper pad portion so that the inner row of apertures on the lower pad portion coincide with the apertures in the upper pad portion to form a plurality of inner vacuum holes and wherein the outer row of apertures on the lower pad portion coincide with outer terminal ends of the channels in the upper pad portion, the material of the lower pad intermediate the inner and outer rows of apertures therein forming a flexible bottom wall for said channels, (d) said upper pad portion having an inwardly and upwardly tapering circumferential sidewall with a groove adjacent the upper end thereof, said pad assembly being adapted to receive a sanding disc on the lower surface thereof with apertures therein coinciding with those in the lower pad assembly, and retained thereon by a flexible backing held in the sidewall groove by elastic retaining means, and (e) a circular rigid head member secured concentrically to the top of the upper pad portion and adapted for connection to rotative and vacuum means, said rigid member having a plurality of apertures therein somewhat larger than, and coinciding with the apertures in the upper pad portion. The inner and outer rows of apertures in the lower pad portion are elongated in the direction opposite to that of rotation of the assembly to provide each aperture with a leading and trailing end, the leading end of the inner row of apertures coinciding with the inner ends of the apertures in the upper pad prtion and the rigid head member.

In accordance with another aspect, the present invention relates to a vacuum sanding assembly having a circular pad and abrasive disc attachable thereto, the pad and disc having corresponding apertures therein for suction of sanded material into said assembly, a device for positioning and loading the abrasive disc onto the pad comprising a circular, planar member having a central upstanding primary pin thereon adapted to centre central apertures in the abrasive disc and pad, an upstanding side wall tapering inwardly on its outer surface and having an O-ring retaining lip at its upper end, and at least a pair of spaced secondary pins secured to and upstanding from the planar surface and corresponding to a selected pair of coincident apertures in the abrasive disc and pad.

BRIEF DESCRIPTION OF THE DRAWINGS

The invention is illustrated by way of example in the accompanying drawings wherein:

FIG. 1 is a partially sectioned, fragmented top view of the several elements of the pad assembly;

DESCRIPTION OF THE PREFERRED EMBODIMENT

Figure 2:
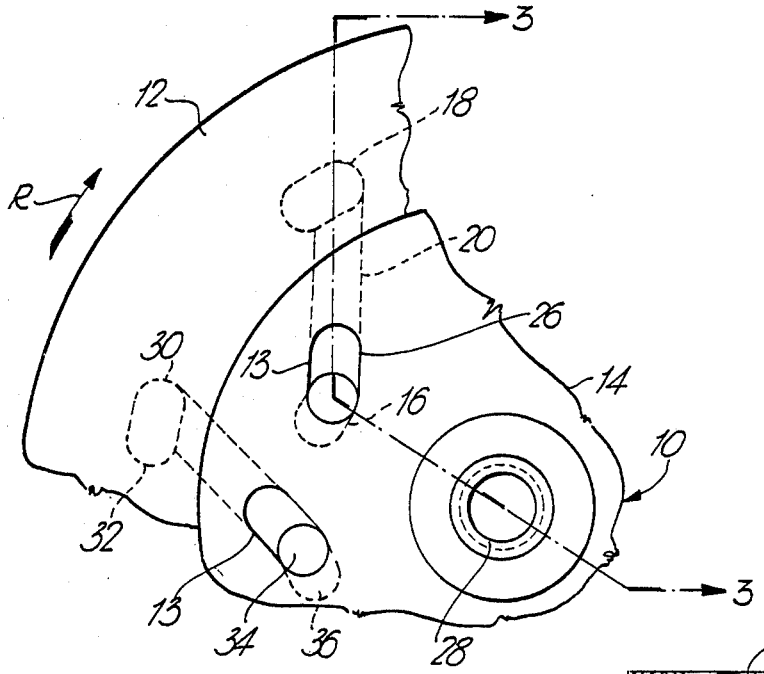
FIG. 2 is another fragmented top view with the elements in assembled condition.

Referring to FIGS. 1 and 2, a pad assembly 10 has circular lower and upper pad portions 11 and 12 and a circular head member 14. In FIG. 1, the lower pad portion is shown as a single sheet of relatively soft, flexible material such as rubber and having a plurality of inner apertures 16 and outer apertures 18 in the surface thereof. The direction of rotation of the assembly is shown by arrow R. The inner row of apertures 16 is positioned approximately midway between the center aperture 58 in the lower pad portion 11 and the outer terminal edge thereof with the outer row of apertures 18 being positioned more or less adjacent to the outer circumferential edge of the assembly. The inner row of apertures are circumferentially, evenly spaced with respect to one another as are the apertures 18 of the outer row and while the apertures 16 and 18 may be circular, I prefer that they be elongated as shown.

In FIG. 1 the upper pad portion 12 is provided with channels 20 which interconnect the apertures 16 and 18 when the upper pad portion 12 is placed on a top surface of the lower pad portion 11 and bonded thereto as shown in FIG. 1. In the upper portion of FIG. 1, the position that the channels 20 will assume are shown in pecked line and in the central part of FIG. 1 which is a top view of the upper pad portion 12, the elongated channels 20 are shown providing a communication between the inner and outer rows of apertures 16 and 18 respectively. The inner terminal ends 22 and outer terminal ends 24 of the channels 20 coincide with the inner and outer apertures 16 and 18 respectively when the upper pad portion 12 overlays the lower pad portion 11.

The upper pad portion is manufactured from resilient material that is quite firm with respect to the material of the lower pad portion.

The head member 14 is of rigid material and is shown in the fragmented portion of FIG. 1. Head 14 has apertures 26 which, when head 14 is bonded to the upper surface of upper pad portion 12, coincide with the inner terminal ends 22 of the channels 20 and the inner row of apertures 16 in the lower pad portion as shown for example in FIG. 2. Preferably, apertures 26 in head 14 are slightly larger than the apertures which they overlay and also, they are preferably elongated as shown in FIG. 1 The head 14 is also provided with a central, threaded sleeve 28 for connection to suitable rotating means.

Referring to FIG. 2, the fragmentary top view of the assembly 10 shows the path of communication between the outer row aperture 18, channel 20, inner row aperture 16 and aperture 26 in the head 14. It will also be evident that because of the elongation of the inner and outer rows of apertures in a direction away from that of rotation R, the outer row of apertures 18 has a "leading" portion 30 and a trailing portion 32 and inner row aperture also has a leading portion 34 and a trailing portion 36.

The reason for providing leading and trailing portions to the above apertures is that when an abrasive disc having apertures therein coincident with those in the pad assembly, it is applied to a bottom surface of the lower pad portion of the pad assembly and held thereon by a flexible skirt and elastic retaining means, there is sometimes slippage between the surface of the abrasive disc and the supporting pad assembly due to the amount of torque applied to the abrasive disc by the surface being ground resulting from a lot of pressure being exerted on the disc by the operator. It will be appreciated that because of the elongation of the apertures and the leading and trailing portions thereof, the abrasive disc can slip rearwardly a substantial amount though the apertures therein will still be in communication with the trailing ends 32 and 36 of the outer apertures 18 and inner apertures 36.

It will also be noted from FIG. 1 and FIG. 2 that the outer apertures 18 are circumferentially offset from the inner apertures 16 and that the channels 20 interconnecting those apertures are angularly directed towards the direction of rotation R of the pad assembly and this angulation provides an improved grit gathering result when the pad is rotated at high speed.

Figure 3:
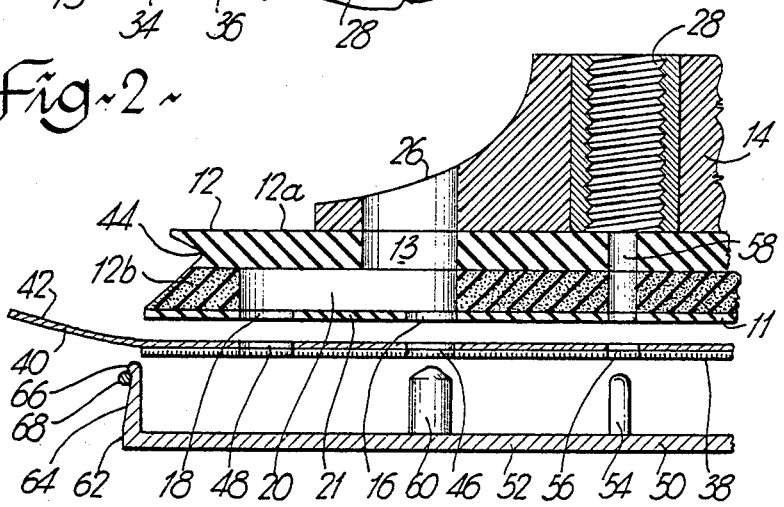
FIG. 3 is a fragmented sectional view taken along the line 3—3 of FIG. 2.

Referring to FIG. 3, the upper pad portion 12 can be manufactured from a single disc member although I prefer to make it from two discs, an upper disc 12*a* and a lower disc 12*b*. Upper disc 12*a* of quite firm but resilient material and a lower disc 12*b* of softer, more flexible material. In either case, the upper pad portion 12 has an aperture 13 therein coincident with aperture 26 in the head 14 and with aperture 16 in the lower pad assembly 11. It will be seen from FIG. 3 that the construction of the upper pad portion 12 provides the channel 20 with upper and end walls and that the material 21 between the inner and outer rows of apertures 16 and 18 in the lower pad assembly provides the channel 20 with a flexible, bottom wall. In cross-section therefore channel 20 has two inlets, 18 and 16 and a large exhaust outlet, 13 and 26.

Figure 4:
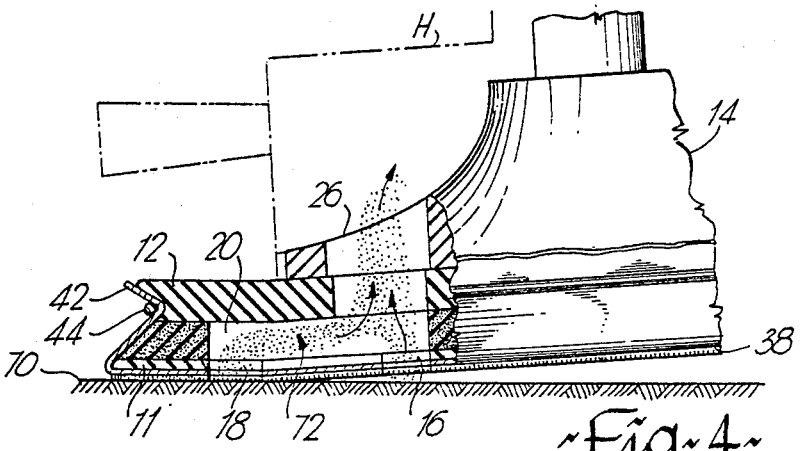
FIG. 4 is a partially sectioned view of the pad assembly in operation.

The abrasive disc 38 is provided with a flexible backing 40 adhesively secured thereto and which incorporates a flexible peripheral skirt 42 which is folded into a groove 44 in the sidewall of the lower pad assembly 12 and retained therein by the indicated taper to that sidewall as well as by a resilient O-ring or other suitable retaining means as shown in FIG. 4.

The abrasive disc 38 is provided with an inner row of apertures 46 and an outer row of apertures 48 and it will be evident from FIG. 3 that when the disc is mounted onto the lower face of the pad, inner apertures 46 are coincident with apertures 16 in the lower pad assembly 11 as well as apertures 13 in the upper assembly and 26 in the head 14 while the outer row of apertures 48 in the disc are coincident with apertures 18 in the lower pad assembly 11.

The present invention also provides for a loading means 50 for quickly and accurately positioning and applying the abrasive disc 38 to the lower face of the pad assembly. The loader 50 has a circular planar platform or surface 52 provided with a central pin 54 which aligns central aperture 56 in the abrasive disc and a central aperture 58 in the pad assembly 10. At least two and preferably three additional pins 60 are provided on the surface of the loader 50 and these pins are positioned so as to be coincident with the inner row of apertures 46 in the abrasive disc and apertures 16 in the lower pad assembly. Additionally, the pins 60 are long or high enough to enter the aperture 13 in the upper ends of the upper pad portion 12 and as aperture 13 does not have a trailing portion, the abrasive disc 38 will be so positioned that its apertures 46 and 48 will be aligned with the leading portions 30 and 34 of the outer apertures 18 and inner apertures 16 respectively.

The outer periphery of the loader 50 has an upstanding wall 62, the outer surface of which tapers inwardly as shown at 64 and is provided with a lip 66 for retaining an elasticized O-ring 68 or the like. It will be appreciated from FIG. 3 that the abrasive disc is first placed downwardly onto the floor or surface 52 of the loader 50 with the apertures being positioned over their respective pins and then the pad assembly is lowered down onto the pins as well. The O-ring 68 can then be moved upwardly and will automatically pull the flexible skirt 42 upwardly along the tapered sidewall of the pad assembly and will come to rest in the groove 44 as shown in FIG. 4.

Alternatively, a telescoping form of loader may be utilized as shown in my Canadian Pat. No. 772,369 of Nov. 28, 1967. Such a telescoping loader would of course have to utilize the pin assembly disclosed herein.

Referring now to FIG. 4, the pad assembly is shown in operation grinding the surface of a workpiece 70. Due to the relatively firm material of the upper pad portion 12, a substantial pressure may be applied to the outer peripheral area of the pad assembly and as most rotary sanding is done with this form of pressure on the peripheral area of the pad, the flexible lower wall in the channel 20 ensures that the maximum amount of surface of the lower pad 11 is in contact with the surface of the work 70.

It will be evident from FIG. 4 that by virtue of the position and size of the apertures and channels, that the grit 72 flows smoothly through the channel 20 and out through the exit apertures 26 into the vacuum housing H shown in pecked line.

Figure 6:
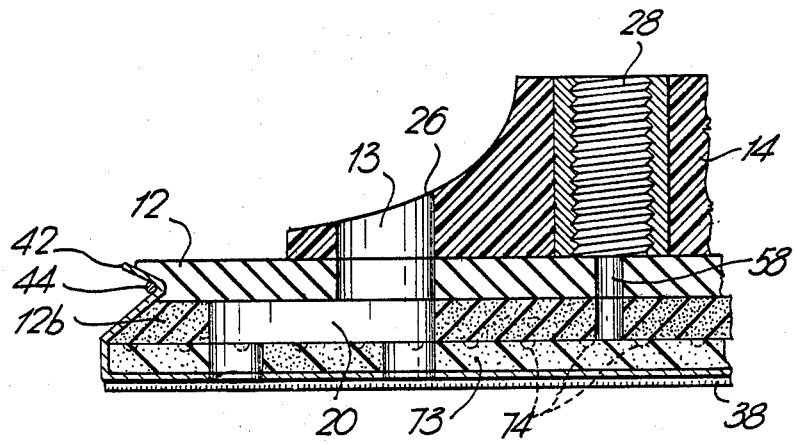
FIG. 6 is a cross-sectional view similar to FIG. 3 illustrating the additional embodiment of FIG. 5.
Figure 5:
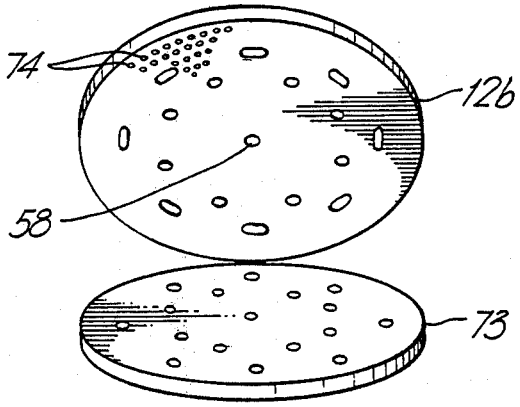
FIG. 5 is a perspective view of a further embodiment of the lower pad assembly 12.

Referring to FIGS. 5 and 6, an additional soft pad 73 formed of sponge material or the like is inserted between the lower pad **12*b* and the abrasive disc 38. As shown in FIG. 5, sponge pad 73 is provided with inner and outer rows of apertures to register with those in the pad member 12*b*. Sponge pad 73 is normally used in situations where a softer sanding application is required, the resiliency of the sponge pad providing more "give" to the abrasive disc when the operator is for example sanding an area of multiple contours. In the past, sometimes the sponge pads 73 slipped away from the lower pad 12*b* after prolonged use. In accordance with the embodiment of FIGS. 5 and 6, the lower pad assembly 12*b* is provided on its bottom surface with a plurality of small protuberances or projections 74 which, when the sponge pad 73 is placed against the lower pad assembly 12*b*, provides additional grip between the two faces of the members in question. While FIG. 5 illustrates only a small number of projections 74 on the lower surface of pad 12*b*, it will be appreciated that these projections can be applied in any density required and normally would cover the whole surface of pad 12*b***.

It will be appreciated that the projections 74 dig into the upper or juxtaposed surface of the sponge pad 73 particularly on the peripheral area that is against the surface being sanded and there is an actual clutch action provided between the two gripped surfaces. It will further be appreciated that even if the face of the sponge pad pulls away slightly from the face of the pad **12*b*, it will not rotationally slip because of the fact that the sponge pad is riding on top of the projections 74**.

While the invention has been described in connection with a specific embodiment thereof and in the specific use, various modifications thereof will occur to those skilled in the art without departing from the spirit and scope of the invention as set forth in the attached claims. The terminology and expressions which have been employed in this disclosure are used as terms of description and not of limitation and there is no intention in the use of such terminology and expressions to exclude any equivalents of the features shown and described or portions thereof but it is recognized that various modifications are possible within the scope of the invention claimed.

I claim:

1. A pad assembly for a vacuum rotary sander, said assembly comprising:

(a) a circular upper pad portion of firm but resilient material, having a plurality of evenly spaced apertures concentrically arranged therein and positioned approximately midway between the centre of said upper pad portion and the circumferential edge thereof, (b) and an elongated channel extending from each said aperture angularly outwardly in the direction of rotation of the assembly, each said channel having an open bottom edge, (c) a lower pad portion of relatively soft, flexible material and having an inner and outer row of evenly spaced concentrically arranged apertures, each of said apertures extending through a top and bottom surface of said lower pad portion, said top surface of said lower pad portion being bonded to said upper pad portion so that the inner row of apertures in the lower pad portion coincide with the apertures in the upper pad portion to form a plurality of inner vacuum holes and wherein the outer row of apertures on the lower pad portion coincide with outer terminal ends of the channels in the upper pad portion, the material of the lower pad portion intermediate the inner and outer rows of apertures therein forming a flexible bottom wall for said channels, (d) said upper pad portion having an inwardly and upwardly tapering circumferential side wall with a groove adjacent an upper end thereof, said pad assembly being adapted to receive a sanding disc on the bottom surface of said lower pad portion, the disc having apertures therein coinciding with those in the lower pad portion and retained thereon by a flexible backing held in the sidewall groove by elastic retaining means, (e) a circular rigid head member secured concentrically to and on top of the upper pad portion and adapted for connection to rotating and vacuum means, said rigid member having a plurality of apertures therein somewhat larger than, and coinciding with the apertures in the upper pad portion; and (f) said inner and outer rows of apertures in the lower pad portion are elongated in the direction opposite to that of rotation of the assembly to provide each aperture with a leading and trailing end, the leading end of the inner row of apertures coinciding with the inner ends of the apertures in the upper pad portion and the rigid head member.

2. A pad assembly according to claim 1 wherein the apertures in the upper pad portion and in the head member are slightly elongated in the direction of the channels.

3. A pad assembly according to claim 1 wherein the lower pad portion has a plurality of projections on the bottom surface, and a secondary pad having apertures therein in registry with the apertures in the lowr pad portion and adapted to be placed between the lower pad portion and an abrasive disc and to be held against rotational slippage relative to the lower pad portion by said projections.

* * * * *